US005899136A

United States Patent [19]

Tarr et al.

[11] Patent Number: 5,899,136

[45] Date of Patent: * May 4, 1999

[54] LOW LEAKAGE PLUNGER AND BARREL ASSEMBLY FOR HIGH PRESSURE FLUID SYSTEM

[75] Inventors: Yul J. Tarr; John T. Carroll, III; Donald J. Benson, all of Columbus, Ind.

[73] Assignee: Cummins Engine Company, Inc., Columbus, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,117

[22] Filed: Dec. 18, 1996

[51] Int. Cl.[6] ..... F01B 11/02

[52] U.S. Cl. ..... 92/170.1; 92/80; 92/82; 92/169.2; 123/495

[58] Field of Search ..... 92/170.1, 168, 92/169.1, 169.2, 80, 82; 123/495

[56] References Cited

U.S. PATENT DOCUMENTS

| | | | |
|---|---|---|---|
| 113,764 | 4/1871 | Hallefas | 92/168 |
| 1,621,858 | 3/1927 | Sherwood | 92/170.1 |
| 1,817,095 | 8/1931 | Penick et al. | 92/170.1 |
| 2,586,537 | 2/1952 | Hapman | 92/170.1 |
| 3,696,714 | 10/1972 | Panigati | 92/170.1 |
| 3,902,404 | 9/1975 | Breit . | |
| 4,329,914 | 5/1982 | Frey . | |
| 4,530,335 | 7/1985 | Torizuka . | |
| 4,717,317 | 1/1988 | Hofer et al. . | |
| 4,991,495 | 2/1991 | Loegel, Sr. et al. . | |
| 5,038,826 | 8/1991 | Kabai et al. . | |
| 5,072,709 | 12/1991 | Long et al. . | |
| 5,096,121 | 3/1992 | Grinsteiner . | |
| 5,441,027 | 8/1995 | Buchanon et al. . | |
| 5,503,128 | 4/1996 | Hickey et al. . | |

FOREIGN PATENT DOCUMENTS

| | | | |
|---|---|---|---|
| 2533536 | 2/1977 | Germany | 92/170.1 |
| 345309 | 5/1937 | Italy | 92/170.1 |

*Primary Examiner*—Thomas E. Denion

*Attorney, Agent, or Firm*—Sixbey, Friedman, Leedom & Ferguson; Charles M. Leedom, Jr.; Tim L. Brackett, Jr.

[57] ABSTRACT

An improved plunger and barrel assembly is provided which includes a plunger reciprocally mounted in a cavity formed in the barrel and a leakage flow reduction device positioned in the cavity for reducing fluid leakage flow around the plunger thus increasing system efficiency. The leakage flow reduction device includes a sealing sleeve removably mounted in the cavity between the plunger and the barrel, which includes a bore for slidably receiving the plunger to form an annular clearance gap between the plunger and the bore. The sealing sleeve is designed to resiliently flex in response to fluid pressure forces to reduce the annular clearance gap so as to minimize fluid leakage through the annular clearance gap. The sealing sleeve is formed as a separate piece from the barrel to permit simple, low cost replacement. The sealing sleeve is preferably applied to a fuel pump having a pump plunger for pressurizing fuel in a high pressure chamber.

13 Claims, 4 Drawing Sheets

LOW LEAKAGE PLUNGER AND BARREL ASSEMBLY FOR HIGH PRESSURE FLUID SYSTEM

TECHNICAL FIELD

This invention relates to a plunger and barrel assembly for a fluid system which effectively minimizing leakage through a clearance between the plunger and the barrel assembly.

BACKGROUND OF THE INVENTION

Engine designers are continually seeking improvements in engine design which improve engine efficiency. One manner of improving engine efficiency is to improve the operational efficiency of the fuel system. Specifically, any leakage of high pressure fuel within the fuel system represents wasted energy that can reduce engine efficiency. Loss of high pressure fuel has recently become an even greater problem as injection pressure levels are increased in an effort to improve fuel economy and reduce emissions as required by recent and upcoming legislation.

Undesirable leakage of fuel often occurs in a component of the fuel system having a member, such as a valve element or a fuel plunger, reciprocally mounted in a bore formed in a body and sized to form a close sliding fit with the inside surface of the body to create a partial fluid seal between the adjacent surfaces. As the fuel pressure increases, a pressure gradient is developed along the length of the seal, i.e., clearance, between the member and opposing wall forming the bore. The extent of the leakage flow through the clearance depends primarily on the magnitude of the pressure gradient, the engagement length, the size of the operating clearance and the fluid viscosity. The size of the operating clearance is affected by the amount of fuel pressure induced dilation or deformation of the body forming the bore. One manner of reducing the leakage is to design the components to achieve a smaller clearance between the plunger and barrel. However, the practice of requiring closer tolerances increases manufacturing costs. Another method of reducing leakage is to design the body to resist pressure induced dilations by increasing the size and/or strength of the body or housing forming the bore. However, this method undesirably increases the size and weight of the components and, thus, the fuel system.

Many fuel systems used in contemporary engines include a reciprocally mounted fuel pressurization plunger incorporated into, for example, a unit fuel injector, such as disclosed in U.S. Pat. No. 5,072,709, or a fuel pump assembly, such as disclosed in U.S. Pat. No. 4,530,335. Each plunger is typically either mechanically or hydraulically operated to pressurize fuel in a pressure chamber for injection into the engine cylinder. For example, U.S. Pat. No. 5,096,121 and 5,441,027 disclose hydraulically actuated intensification plunger assemblies. However, these references do not suggest reducing the leakage between the plunger and adjacent bore wall and, therefore, are subject to the disadvantages discussed hereinabove.

U.S. Pat. No. 4,991,495 to Loegel, Sr. et al. discloses a pumping mechanism including a plunger mounted in a bore and a plurality of inserts positioned in series along the plunger for sealing the space between the plunger and its housing. The inserts include thrust and sealing rings which deform and expand radially in response to axial fluid-induced forces imparted by adjacent inserts. However, this sealing assembly requires an excessive number of discs and other parts creating a complex and expensive arrangement which is costly and difficult to maintain. Moreover, this device undesirably requires the resealing of two gaps, one on each side of the inserts, during each pumping stroke of the plunger thus increasing the likelihood of less than minimal leakage.

U.S. Pat. No. 5,038,826 to Kabai et al. discloses a three-way valve including a piston slidably positioned in a valve body. High pressure fuel is delivered to the valve via aligned ports formed in the valve body and the piston. An integral portion of the piston or the valve body is acted upon by supply fuel pressure to reduce the clearance between the piston and a valve body thereby reducing the leakage between the components. Although deformation of the integral portion tends to close the clearance gap to reduce leakage, the resulting close tolerances may result in increased wear, or possibly scuffing, of the valve body or piston resulting, over time, in excessive clearances. For the Kabai et al. design, excessive wear would eventually require replacement of the entire piston and/or valve body, unnecessarily increasing costs. Also, the integral portion disadvantageously provides reduction in the pressure gradient over only a limited, localized portion of the seal length and thus fails to minimize leakage in an optimum manner. In addition, the integral portion is formed by machining internal passages into the valve body or piston undesirably increasing manufacturing time and costs.

Consequently, there is a need for an improved plunger and barrel assembly which effectively and optimally minimizes fluid leakage through the clearance between the plunger and barrel while minimizing the costs and size of the assembly.

SUMMARY OF THE INVENTION

It is an object of the present invention, therefore, to overcome the disadvantages of the prior art and to provide an improved plunger and barrel assembly capable of optimally minimizing fuel leakage between the plunger and barrel thus increasing efficiency.

It is another object of the present invention to provide an improved plunger and barrel assembly which can be applied to either a valve or a pump to effectively reduce fluid leakage between the pump or valve member and its body forming a bore.

It is yet another object of the present invention to provide an improved plunger and barrel assembly which can be applied to fuel pumps, including unit fuel injectors and reciprocating plunger type pumps positioned upstream from a fuel injector in a high pressure fuel system.

It is a further object of the present invention to provide an improved plunger and barrel assembly which causes the operating clearance between the plunger and barrel to decrease as fuel pressure increases.

It is a still further object of the present invention to provide an improved plunger and barrel assembly including a resilient portion which permits the material for the resilient portion to be selected independently from the barrel to better meet lubricating and structural requirements for the components.

Yet another object of the present invention to provide an improved plunger and barrel assembly which minimizes the costs of manufacturing a blind bore formed in the barrel.

Still another object of the present invention is to provide an improved plunger and barrel assembly wherein the plunger bore is substantially insensitive to the distorting effects of clamping or mounting loads on the assembly.

Another object of the present invention is to provide an improved plunger and barrel assembly which can be easily and inexpensively refurbished to include a new bore-forming surface without replacing the barrel.

A further object of the present invention is to provide an improved plunger and barrel assembly including a resilient sealing sleeve which removes the fluid sealing function from the barrel.

Yet another object of the present invention is to provide an improved plunger and barrel assembly including a resilient sealing sleeve which is easily replaceable.

Another object of the present invention is to provide an improved plunger and barrel assembly including a resilient sealing sleeve which allows the barrel to be designed and sized to limit operating stresses and perhaps permit increased radial dilation of the barrel instead of being sized to limit radial dilation.

Still another object of the present invention is to provide an improved plunger and barrel assembly for a fuel pump which increases the efficiency of the fuel system and minimizes the required pumping capacity.

These as well as additional objects of the present invention are achieved by providing a fluid control device for use in a high pressure fluid system, comprising a device body including a cavity and a high pressure circuit, a plunger positioned for reciprocal movement in the cavity and a leakage flow reduction device positioned in the cavity for reducing fluid leakage flow from the fluid circuit. The leakage flow reduction device includes a sealing sleeve removably mounted in the cavity between the plunger and the device body, and including a bore for slidably receiving the plunger to form an annular clearance gap between the plunger and the bore. The sealing sleeve is designed to resiliently flex in response to fluid pressure forces to reduce the annular clearance gap so as to minimize fluid leakage through the annular clearance gap. The sealing sleeve may include an outer annular surface upon which fluid pressure forces directly act to cause the sealing sleeve to flex radially inwardly so as to reduce the annular clearance gap. The sealing sleeve may also include an inner flexible portion and an outer portion rigidly mounted on the device body. The outer portion may include an annular step for sealingly abutting an annular land formed on the device body. Axial clamping forces acting on the outer portion may be used to rigidly hold the sealing sleeve in position against the annular land. The sealing sleeve may be press-fit into the cavity against the device body. An inner end of the sealing sleeve is positioned a spaced distance from the inner end of the cavity so that fluid pressure forces acting on the inner end of the sealing sleeve tend to bias the sleeve into sealing abutment against the annular land. Thus, the cavity may be formed in a one-piece device body and the sealing sleeve held in the cavity by axial clamping forces, or, alternatively, the device body may be comprised of two parts which when connected together, form a cavity for securing the sealing sleeve.

Preferably, the present invention is incorporated into a fuel pump for use in a high pressure fuel system wherein the plunger is operable to move through periodic pumping strokes for pressurizing fuel in a high pressure fuel chamber formed in the inner end of the cavity.

DESCRIPTION OF THE PREFERRED EMBODIMENT

Figure 1:
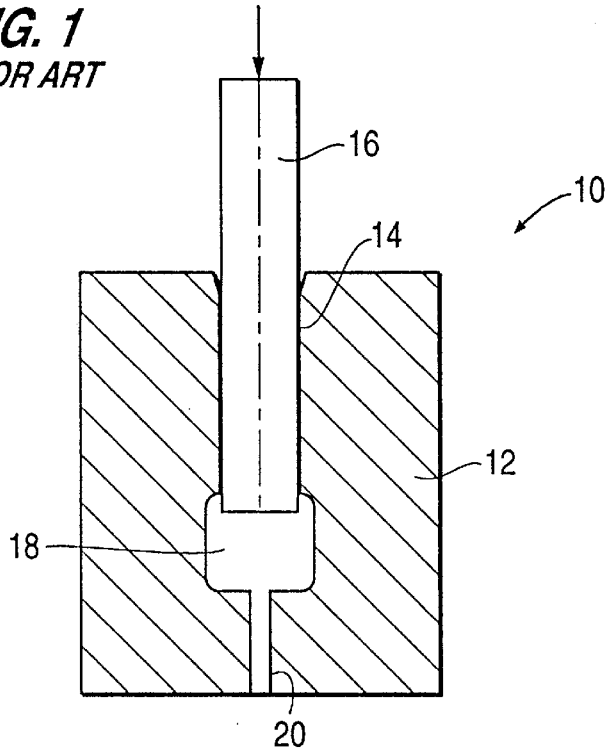
FIG. 1 PRIOR ART
FIG. 1 is a partial cross sectional view of a conventional plunger and barrel assembly used in a prior art fuel pump.

FIG. 1 is provided to clearly show the advantages of the plunger and barrel assembly of the present invention when incorporated into a fuel pump over other fuel pumps using conventional plunger and barrel assemblies. FIG. 1 represents a prior art plunger and barrel assembly indicated at 10 which includes a barrel 12 containing a plunger bore 14, and a plunger 16 reciprocally mounted in bore 14. Plunger 16 is operable to move through advancement and retraction strokes so as to periodically pressurize fluid, i.e. fuel, in a high pressure chamber 18 formed in one end of bore 14. High pressure fuel from high pressure chamber 18 is forced through high pressure circuit 20 for delivery to an engine. Plunger 16 and bore 14 are sized relative to one another so that plunger 16 forms a close sliding fit with the inside surface of barrel 12 forming bore 14 to create a partial fluid seal in an annular clearance gap formed between the adjacent surfaces. During reciprocation of plunger 16, a pressure gradient is developed axially along the engagement or sealing length of the annular gap producing a leakage flow from high pressure chamber 18 outwardly. Also, the leakage flow is increased as the fuel pressure in high pressure chamber 18 increases. The pressure in chamber 18 is often high enough to cause barrel 12 to dilate, or resiliently deform, radially outwardly so as to increase the size of the annular clearance gap thus undesirably increasing the leakage flow. Although this leakage flow functions to advantageously lubricate plunger 16, the leakage flow also represents lost energy which reduces fuel system efficiency and increases the required pumping capacity of the assembly.

Figure 2:
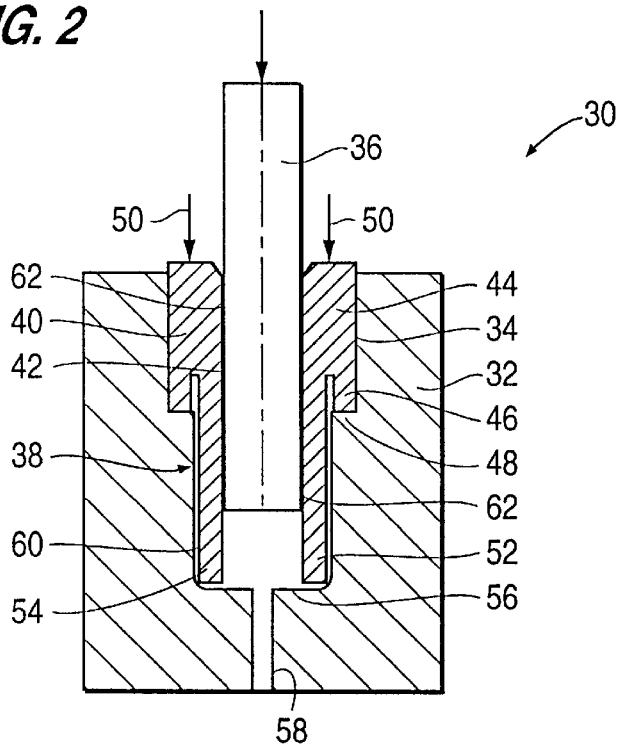
FIG. 2 is a partial cross sectional view of the plunger and barrel assembly designed in accordance with a preferred embodiment of the present invention.
Figure 3:
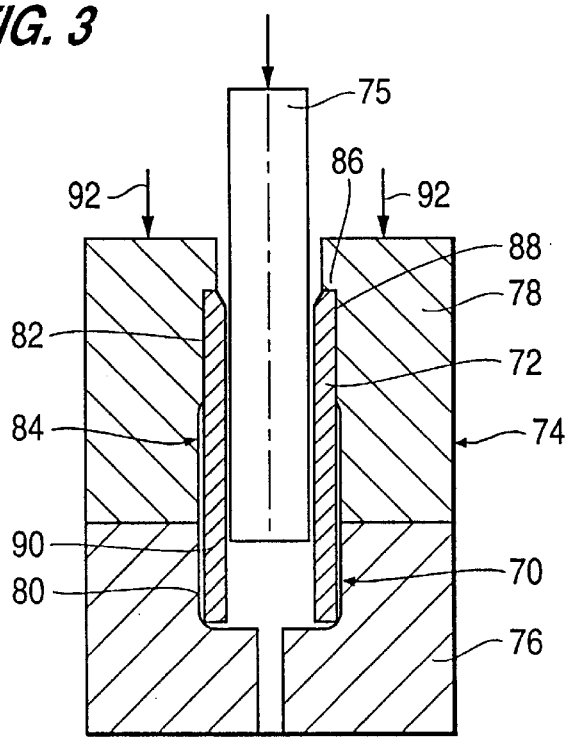
FIG. 3 is a partial cross sectional view of a second embodiment of the plunger and barrel assembly of the present invention.

The plunger and barrel assemblies of the present invention as shown in FIGS. 2 and 3 functions to minimize the leakage flow around the plunger thus increasing fuel system efficiency and decreasing the required pumping capacity while permitting effective reciprocation of the plunger without increasing the size of the assembly. Referring to FIG. 2, the preferred embodiment of the present plunger and barrel assembly is shown as applied to a fuel pump indicated generally at 30. Fuel pump 30 includes a body or barrel 32 having a cavity 34 formed therein, a plunger mounted for reciprocal movement in cavity 34 and a leakage flow reduction device 38 mounted in cavity 34 between plunger 36 and barrel 32. Fuel pump 30 of the present invention could be incorporated into a variety of applications, such as being integrated into a unit fuel injector, or a fuel pump in a high pressure fuel system positioned upstream of a fuel injector. The plunger and barrel assembly could also be incorporated in an hydraulically-actuated intensification pump arrangement. In addition, the plunger and barrel assembly of the present invention could be incorporated into another type of fluid control device, such as a high pressure fuel valve wherein plunger 36 functions as a valve element for engaging a valve seat formed on, for example, the barrel.

Leakage flow reduction device 38 includes a sealing sleeve 40, positioned in cavity 34, which includes a bore 42 for receiving plunger 36. Sealing sleeve 40 includes an outer portion 44 including an annular step 46 for sealingly abutting an annular land 48 formed on barrel 32 inside cavity 34. Sealing sleeve 40 is rigidly held in place in cavity 34 by axial clamping forces, indicated at 50, supplied by a mounting or clamping device (not shown) so as to maintain annular step 46 in sealed abutment with annular land 48. Thus, sealing sleeve 40 is designed to be removably positioned in cavity 34. Axial clamping forces 50 may be provided by an injector clamping device such as shown in U.S. Pat. No. 5,503,128, which is hereby incorporated by reference, wherein fuel pump 30 is integrated into an injector and the clamping device also provides enough force to hold the fuel injector and barrel 32 in position in an injector mounting bore formed in an engine.

Sealing sleeve 40 also includes an inner flexible portion 52 integrally formed with outer portion 44 and extending inwardly into cavity 34. An inner end 54 of inner flexible portion 52 terminates at a spaced distance from the inner end of cavity 34. Plunger 36 is reciprocally mounted in bore 42 so as to form a high pressure fluid chamber 56 at the inner end of cavity 34. A high pressure fuel circuit 58 directs supply fuel into high pressure chamber 56 and permits the flow of high pressure fuel from high pressure chamber 56 for injection into an engine via, for example, a fuel injector nozzle assembly.

Inner flexible portion 52 is generally cylindrically shaped and includes an outer diameter sufficiently less than the inner diameter of cavity 34 so as to form an outer annular chamber 60. Outer annular chamber 60 is in continuous fluidic communication with high pressure chamber 56 via an end gap 61 formed between the inner end 54 of inner flexible portion 52 and the inner end of cavity 34. Thus, the fuel pressure in outer annular chamber 60 is substantially equal to the fuel pressure experienced in high pressure chamber 56 throughout movement of plunger 36. Also, the outer diameter of plunger 36 and the inner diameter of sealing sleeve 44 are sized so that an annular clearance gap 62 is formed between the outer surface of plunger 36 and the inner surface of sealing sleeve 40 to create a close sliding fit and a partial fluid seal. As a result, the fuel pressure in outer annular chamber 60 will be greater than the fuel pressure in at least a portion of the annular clearance gap 62 thus causing inner flexible portion 52 to flex inwardly to reduce the size of gap 62 and the leakage flow therethrough.

During operation, plunger 36 retracts to enlarge high pressure chamber 56 while supply fuel from circuit 58 enters chamber 56. At some point during the inward or advancement stroke of plunger 36 toward high pressure chamber 56, the fuel in high pressure chamber 56 will be compressed by plunger 36 thereby increasing the fuel pressure in both high pressure chamber 56 and outer annular chamber 60 equally. Thus, high pressure fuel at the same pressure acts on both the inner surface of flexible portion 52 adjacent high pressure chamber 56 and the outer annular surface of inner flexible portion 52 forming annular chamber 60. As a result, the inner end of inner flexible portion 52 is exposed to equal pressure forces thereby preventing fuel pressure induced dilation of the portion of inner flexible portion 52 positioned adjacent high pressure chamber 56. In addition, the partial fluid seal created in annular clearance gap 62 between plunger 36 and inner flexible portion 52 tends to create a throttling effect which reduces the pressure along the axial length of annular clearance gap 62. The fuel pressure in outer annular chamber 60, however, positioned opposite annular clearance gap 62 is maintained at the high pressure level equal to the pressure in high pressure chamber 56. Thus, the portion of inner flexible portion 52 which overlaps with plunger 36, i.e. positioned adjacent annular clearance gap 62, experiences fluid pressure forces on its outer surface which tend to flex or resiliently deform that portion of sealing sleeve 40 radially inwardly. Consequently, annular clearance gap 62 is reduced by the fluid pressure induced flexing of sealing sleeve 40 resulting in a reduction in the leakage flow rate through annular clearance gap 62. Although the high pressure fuel in outer annular chamber 60 may cause fuel induced dilation of barrel 32, the dilation does not adversely affect the seal between plunger 36 and sealing sleeve 40.

FIG. 3 illustrates a second embodiment of the present plunger and barrel assembly wherein a leakage flow reduction device 70 includes a generally cylindrically shaped sealing sleeve 72 positioned between a two piece barrel 74 and a plunger 75. Two piece barrel 74 includes a first piece 76 and a second piece 78 each having respective cavities 80 and 82 which form a complete cavity 84 when first piece 76 is positioned in aligned abutment against second piece 78. Second barrel piece 78 includes an upper annular land 86 and an annular recess 88 in which sealing sleeve 72 is press-fit to securely connect sleeve 72 to second barrel piece 78. An outer end of sealing sleeve 72 abuts upper annular land 86 to axially position sealing sleeve 72 in cavity 84. After sealing sleeve 72 is press-fit into annular recess 88, first barrel piece 76 may then be connected to second barrel piece 78 in any conventional manner, such as by an outer retainer threadably engaging second barrel piece 78 and holding first and second pieces 76 and 78 in compressive abutting relationship. Sealing sleeve 72 includes an inner flexible portion 90 which is structurally and functionally the same as inner flexible portion 52 of the previous embodiment of FIG. 2. The fuel pressure in high pressure chamber 56 acts on the inner end 54 of inner flexible portion 80 so as to bias sealing sleeve 72 upwardly into abutment with upper annular land 86 to assist in sealing the connection between sealing sleeve 72 and second barrel piece 78. Clamping forces, indicated at 92, function to hold the fuel pump in position and also may be used to secure first and second barrel pieces 76 and 78 in abutment with each other.

Sealing sleeve 40, 72 is formed of a material, and inner flexible portion 52, 90 with a thickness, which permit the optimum amount of radial flexing or displacement to achieve enhanced leakage flow reduction for a given application. The desired radial displacement of sleeve 40, 72 will depend on the initial unloaded radial clearance size of gap 62 and the fuel pressure created in chamber 56.

Figure 4:
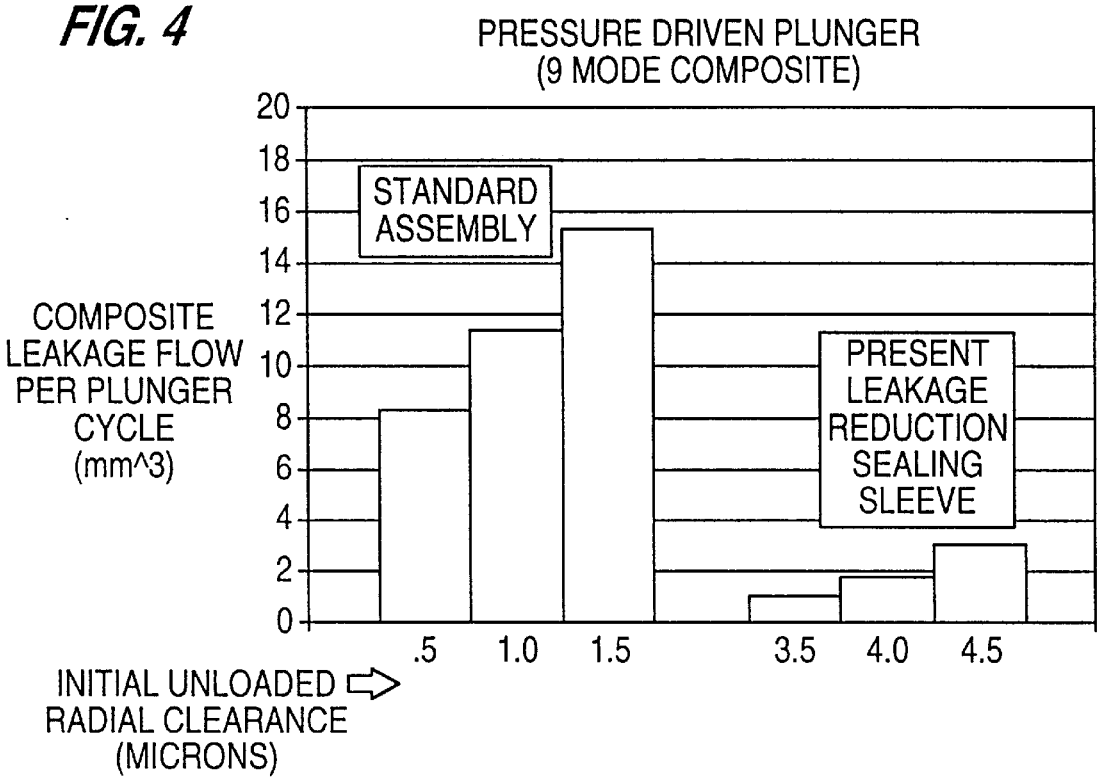
FIG. 4 is a graphical illustration of the leakage reduction effects of the present invention compared to a conventional assembly such as disclosed in FIG. 1.
Figure 5B:
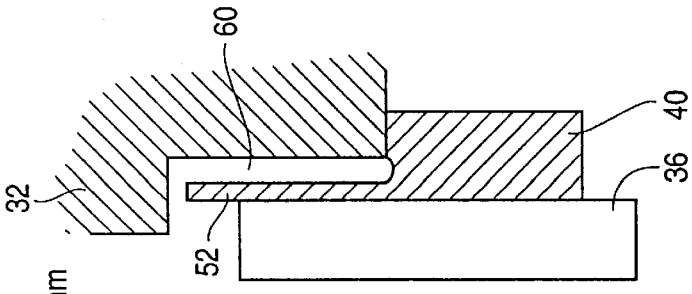
FIG. 5 is a graphical illustration of the radial displacement of the plunger and barrel, and the radial clearance of the clearance gap, of the plunger and barrel assembly of the present invention along the length of the sealing sleeve.
Figure 5A:
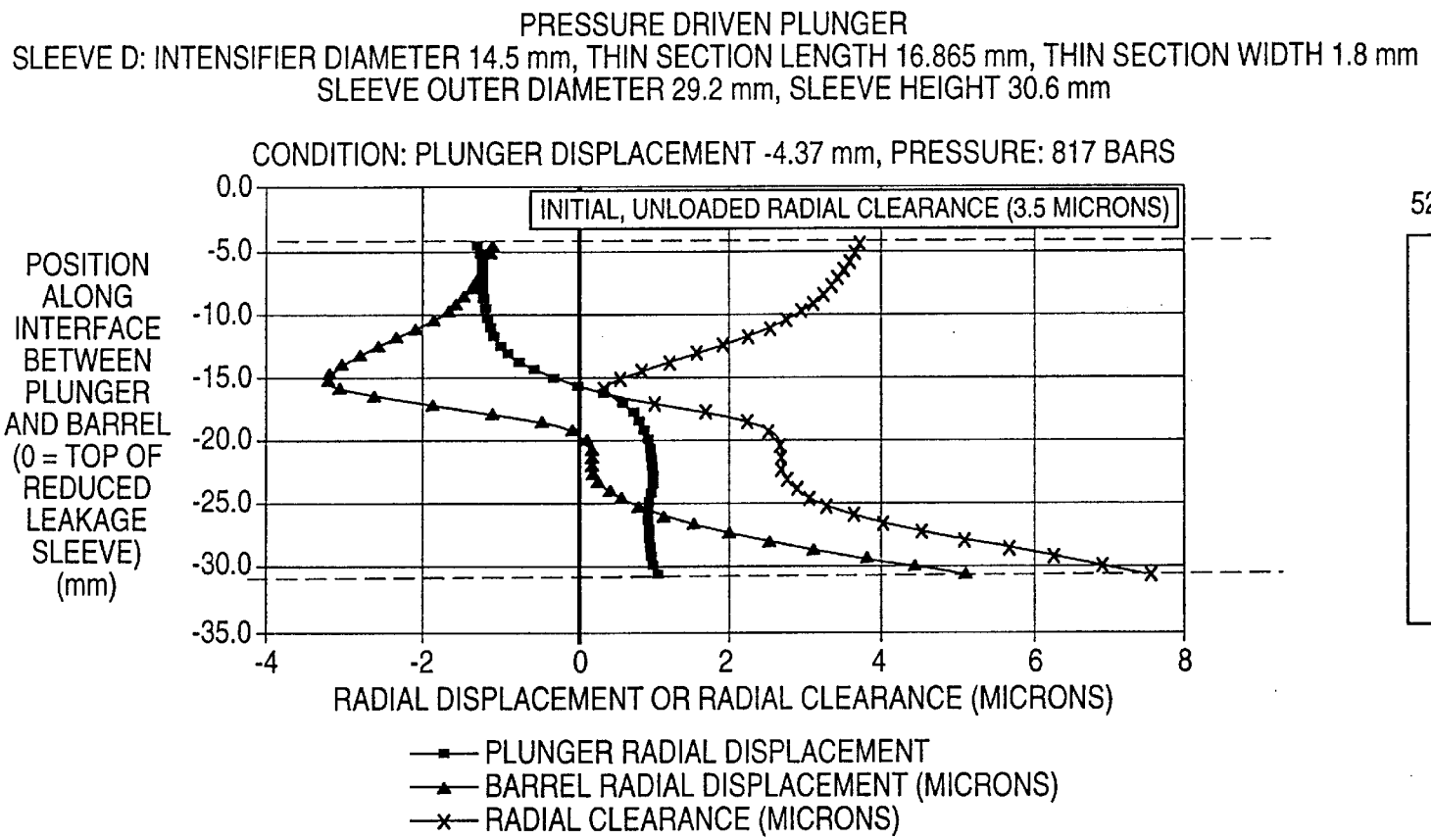
Figure 6B:
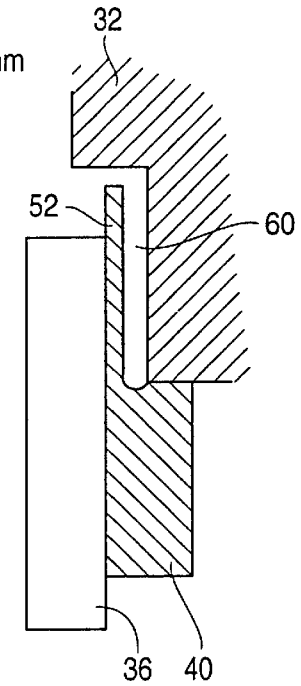
FIG. 6 is a graphical illustration of the pressure in the annular clearance gap along the length of the sealing sleeve of the present invention.
Figure 6A:
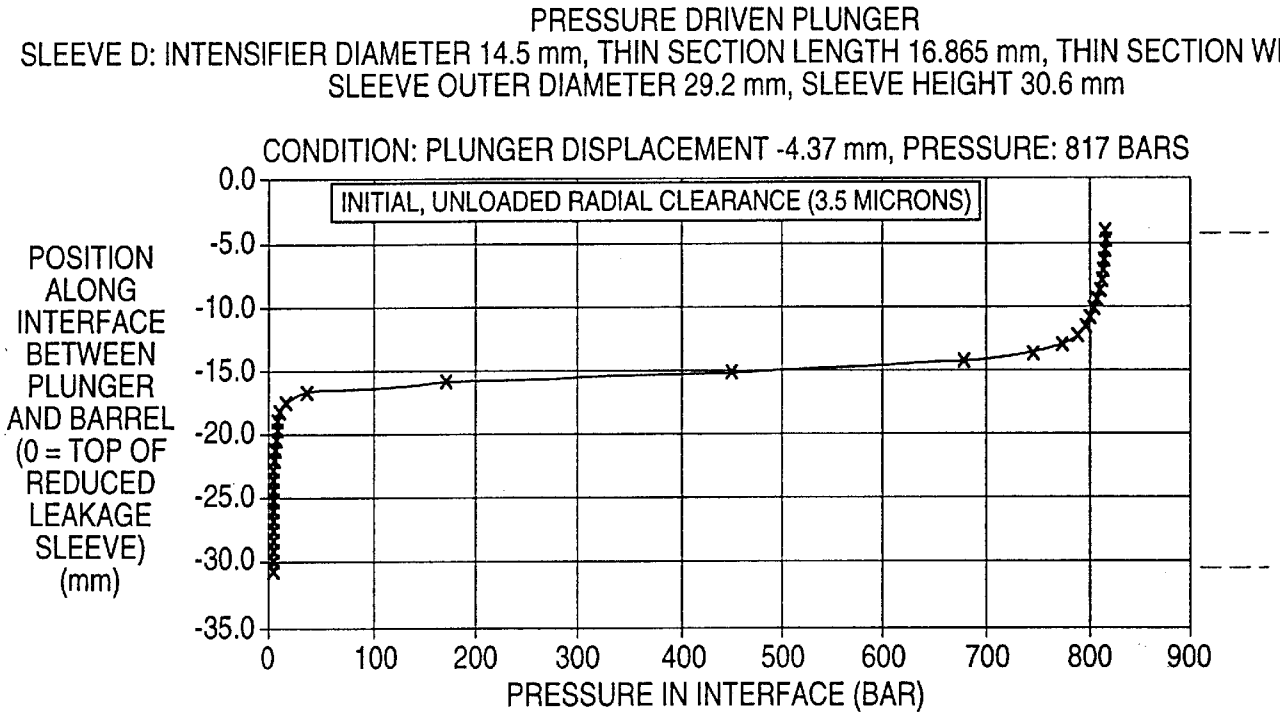

The low leakage plunger and barrel assembly of the present invention results in significant advantages over conventional high pressure fluid control devices. First, the leakage flow reduction device of the present invention effectively reduces fluid leakage between a pump or valve member and the body forming the member bore so as to increase the efficiency of the high pressure fluid system. In the fuel pump application, the present invention further functions to rninmize the required pumping capacity of the fuel pump. This advantage is illustrated in FIGS. 4–6. As shown in FIG. 4, the sealing sleeve of the present invention reduces leakage by 90% as compared to a standard barrel and sleeve. Preferably, the radial clearance of annular clearance gap 62 is greater than the radial clearance of a conventional gap to permit the pressure induced radial displacement of the sleeve. Of course, the smaller clearance associated with a standard assembly increases as the fuel pressure increases due to the fuel pressure induced dilation of the barrel, unlike the inverse reaction of the present sealing sleeve which gradually displaces as fuel pressure increases resulting in a decrease the annular clearance gap 62. FIG. 5 illustrates the radial displacement of the barrel and plunger, and the radial clearance of gap 62 along the length of the sealing sleeve 40. As can be seen, the radial clearance of gap 62 reduces significantly in the area adjacent the outermost portion of inner flexible portion 52. Referring to FIG. 6, it can be seen that the pressure in gap 62 decreases significantly in the area where the radial clearance is minimized. During operation, the difference in pressure across the outermost portion of inner flexible portion 52, due to the partial fluid seal of the clearance gap, causes the outermost portion to displace or flex radially inwardly to reduce the size of the gap as shown in FIG. 4 thus further reducing the pressure. Of course, displacement of inner flexible portion 52 occurs at the outermost portion since the pressure in the portion of annular clearance gap 62 positioned adjacent inner flexible portion 52 is minimized at the furthest point from high pressure chamber 56.

A second advantage of the present invention is that sealing sleeve 40, 72 of the present invention can be easily removed and replaced with a new sealing sleeve thereby permitting simple, quick and low cost maintenance. Third, by forming inner flexible portion 52, 80 as part of a sealing sleeve separate from the body or barrel, the leakage flow reduction device of the present invention permits a sealing sleeve to be formed of a material which better enables the sleeve to achieve its requirements, i.e. lubrication, wear resistance, and resiliency, independent from the material selection for the barrel. Thus, sealing sleeve 40, 72 can be formed of any material, e.g., metallic, nonmetallic or composite, which permits the proper amount of flexing and resiliency to optimally minimize leakage flow. Fourth, the present leakage flow reduction device functions to decrease the operating clearance between the plunger and barrel as the fuel pressure increases unlike prior art devices which result in an increased clearance gap at higher pressure levels. Fifth, by comparing FIGS. 1 and 2, it can be seen that the present sealing sleeve 40, 72 increases the engagement length between the plunger 36 and its complementary bore thus permitting increased reduction in leakage flow. Sixth, the present invention avoids the high manufacturing costs associated with forming a blind bore having a precise diameter by permitting a through-bore to be formed in the sealing sleeve. Seventh, the present invention also advantageously removes the sealing function from the barrel so that fluid pressure induced dilation of the barrel does not affect the plunger clearance seal while permitting the barrel to be designed to limit operating stresses. Eighth, the plunger and barrel assembly of the present invention forms a plunger bore which is substantially insensitive to the distorting effects often experienced by the clamping or mounting loads 50, 92 imparted to the assembly. Since inner flexible portion 52, 90 is not directly supported by the barrel and is surrounded by high pressure fuel, the distorting effects of the mounting loads are substantially isolated from this portion of the sealing sleeve.

INDUSTRIAL APPLICABILITY

The plunger and barrel assembly including the leakage flow reduction device of the present invention may be used in many high pressure fluid systems where effective minimization of leakage flow between a movable plunger and a corresponding bore is desired. The present invention is particularly advantageous for use in a high pressure fuel pump positioned in a high pressure fuel system of, for example, an internal combustion engine of any vehicle or industrial equipment.

We claim:

1. A fluid control device for use in a high pressure fluid system, comprising:

a device body including a cavity and a high pressure circuit;

a plunger having a diametrical extent and positioned for reciprocal movement in said cavity;

a leakage flow reduction means positioned in said cavity for reducing fluid leakage flow from said fluid circuit, said leakage flow reduction means including a sealing sleeve removably mounted in said cavity between said plunger and said device body, said sealing sleeve including an inner annular surface defining a bore for slidably receiving said plunger, said bore having a diametrical extent larger than said plunger diametrical extent to form an annular clearance gap between said plunger and said inner annular surface, wherein said sealing sleeve resiliently flexes in response to fluid pressure forces to reduce yet maintain said annular clearance gap so as to minimize fluid leakage flow through said annular clearance gap, wherein said sealing sleeve includes an outer annular surface, said fluid pressure forces acting directly on said outer annular surface to cause said sealing sleeve to flex radially inwardly, said sealing sleeve including an inner flexible portion and an outer portion rigidly mounted on said device body, said outer annular surface being formed on said inner flexible portion, further including an outer annular chamber formed adjacent said outer annular surface, said outer portion including an annular step for sealingly abutting an annular land formed on said device body so as to fluidicallv seal one end of said outer annular chamber, said sealing sleeve being rigidly held in sealing position against said annular land by an axial clamping force acting on said outer portion.

2. The fluid control device of claim 1, wherein said sealing sleeve is press-fit into said cavity against said device body and fluid pressure forces acting on an inner end of said sealing sleeve tends to bias said sleeve into sealing abutment with said annular land.

3. The fluid control device of claim 1, wherein said sleeve is formed of a material having a higher degree of resiliency than a material forming said device body.

4. The fluid control device of claim 2, wherein said device body includes a first portion and a second portion in abutment with said first portion, said cavity formed in both said first and said second portion, said sealing sleeve being press-fit to said first portion and extending along said cavity in spaced relationship with said second portion of said body to form said outer annular chamber.

5. A fuel pump for use in a high pressure fuel system, comprising:

a barrel including a cavity and a high pressure fuel circuit;

a high pressure fuel chamber positioned in said cavity;

a plunger positioned for reciprocal movement in said cavity and operable to move through periodic pumping strokes for pressurizing fuel in said high pressure fuel chamber;

a leakage flow reduction means positioned in said cavity for reducing fuel leakage flow from said high pressure fuel chamber, said leakage flow reduction means including a sealing sleeve removably mounted in said cavity between said plunger and said barrel, said sealing sleeve including an outer annular surface and a bore for slidably receiving said plunger to form an annular clearance gap between said plunger and said bore, wherein said sealing sleeve resiliently flexes in response to fuel pressure induced forces acting on said outer annular surface to reduce said annular clearance gap so as to minimize fuel leakage flow through said annular clearance gap, wherein said sealing sleeve includes an inner flexible portion and outer portion rigidly mounted on said barrel, said inner flexible portion including a distal end free from axial abutment with said barrel to define a fuel flow gap.

6. The fuel pump of claim 5, wherein said fuel pressure forces act directly on said outer annular surface to cause said sealing sleeve to flex radially inwardly.

7. The fuel pump of claim 6, wherein said outer portion includes an annular step for sealingly abutting an annular land formed on said barrel.

8. The fuel pump of claim 6, wherein said sealing sleeve is rigidly held in position against said annular land by an axial clamping force acting on said outer portion.

9. The fuel pump of claim 6, wherein said sealing sleeve is press-fit into said cavity against said barrel and fuel pressure forces acting on an inner end of said sealing sleeve tends to bias said sleeve into sealing abutment with said annular land.

10. The fuel pump of claim 5, wherein said sleeve is formed of a material having a higher degree of resiliency than a material forming said barrel.

11. The fuel pump of claim 7, wherein said barrel includes a first portion and a second portion in abutment with said first portion, said cavity formed in both said first and said second portion, said sealing sleeve being press-fit to said first portion and extending along said cavity in spaced relationship with said second portion of said body to form an annular high pressure chamber.

12. A leakage flow reduction device for use in a high pressure fuel pump which includes a barrel containing a cavity, a high pressure fuel chamber positioned in the cavity, a high pressure fuel circuit providing flow to and from the high pressure chamber, a plunger positioned for reciprocal movement in the cavity and operable to move through periodic pumping strokes for pressurizing fuel in the high pressure fuel chamber, comprising;

a replaceable sealing sleeve removably mounted in the cavity between the plunger and the barrel for reducing fuel leakage flow from the high pressure fuel chamber, said replaceable sealing sleeve including an outer annular surface and a bore for slidably receiving the plunger to form an annular clearance gap between the plunger and said bore, wherein high pressure fuel from said high pressure chamber acts on said outer annular surface to prevent dilation of said replaceable sealing sleeve so as to prevent increased fuel leakage flow through said annular clearance gap, said replaceable sealing sleeve including an inner flexible portion including a distal end portion mountable in the barrel so as to be radially unsupported around an entire circumference of said distal end portion.

13. The leakage flow reduction device of claim 10, wherein said replaceable sealing sleeve resiliently flexes in response to fuel pressure induced forces acting on said outer annular surface to reduce said annular clearance gap thereby reducing fuel leakage flow through said annular clearance gap.

* * * * *